US005720667A

United States Patent [19]

Tu

[11] Patent Number: 5,720,667

[45] Date of Patent: Feb. 24, 1998

[54] GOLF TARGETING DEVICE

[75] Inventor: Wan-Chun Tu, Changhua, Taiwan

[73] Assignee: Taitung Sports Goods Co., Changhua, Taiwan

[21] Appl. No.: 763,537

[22] Filed: Dec. 10, 1996

[51] Int. Cl.[6] ..... A63B 69/36

[52] U.S. Cl. ..... 473/162

[58] Field of Search ..... 473/162, 163, 473/164, 157, 158–160, 171, 174, 181

[56] References Cited

U.S. PATENT DOCUMENTS

| | | | |
|---|---|---|---|
| 1,952,187 | 3/1934 | Wade | 473/162 |
| 2,057,504 | 10/1936 | Schafer | 473/162 |
| 3,038,726 | 6/1962 | Hesidence | 473/162 |
| 3,669,454 | 6/1972 | Kolonel | 473/162 |
| 4,886,274 | 12/1989 | Park | 473/164 |
| 4,988,106 | 1/1991 | Coonrod | 473/162 |
| 5,401,027 | 3/1995 | Surbeck | 473/162 |
| 5,429,368 | 7/1995 | Adams | 473/162 |

*Primary Examiner*—Mark S. Graham
*Attorney, Agent, or Firm*—Bacon & Thomas

[57] ABSTRACT

A golf targeting device having a targeting seat, a movable winder, and an artificial lawn fastened at both ends between the targeting seat and the movable winder. The targeting seat is provided with a resilient rubber pad having a grip and a targeting sign at the front end and an engagement body having a groove and two recesses at the rear end. The movable winder is formed by a square U-shaped holder pivotally joined to a cylinder and provided with a handle extending upwardly at the bottom middle section.

1 Claim, 6 Drawing Sheets

GOLF TARGETING DEVICE

BACKGROUND OF THE INVENTION

The present invention relates to a golf targeting device, especially to a targeting device for practicing golf, comprising a targeting seat, a movable winder, and an artificial lawn fastened between the targeting seat and the movable winder by both ends whereby the device can be easily rolled up into a tiny space for storage or carried by curling up the artificial lawn onto a cylinder of the movable winder to avoid corrugaged folding lines, and the golf ball in practice will bounce back automatically by a resilient rubber pad disposed at the front end of the targeting seat for the convenience of repeated use.

Please refer to FIG. 1. A conventional golf targeting device is provided with a targeting seat 1 forming a slope at the top surface and having an L-shaped channel 2 defining two lateral sides, a ball groove 4 disposed at the middle section and a ball path 5 communicating the L-shaped channel 2 and the ball groove 4. An artificial lawn 3 is provided, extending from the top surface of the targeting seat downwards for a certain length.

Please refer to FIG. 2. To store or carry the conventional golf targeting device, the artificial lawn 3 is folded into several parts, overlaying on the targeting seat 3. For use, the artificial lawn is unfolded into its normal status.

Yet, there are several drawbacks inherent in such golf targeting device. First, in addition to occupying a lot of space, the artificial lawn folded but unfixed can easily come off. Second, the artificial lawn folded for a long time will result in corrugated folding lines when spreaded out again for use as shown in. FIG. 2. Third, it is quite inconvenient that the golf ball pushed away must be picked up and placed into position each time when the golf ball rolls out of the L-shaped channel 2.

SUMMARY OF THE PRESENT INVENTION

It is, therefore, the primary object of the present invention to provide a golf targeting device, comprising a targeting seat, a movable winder and an artificial lawn fastened between the targeting seat and the movable winder by both ends; wherein the artificial lawn can be wound up onto a cylinder of the movable winder, without producing corrugated folding lines, for storage or transporting.

It is another object of the present invention to provide a golf targeting device; wherein the golf ball in practice will bounce back automatically by a resilient rubber pad disposed at the front end of the targeting seat for the convenience of repeated use.

DETAILED DESCRIPTION OF THE PREFERRED EMBODIMENTS

Figure 1:
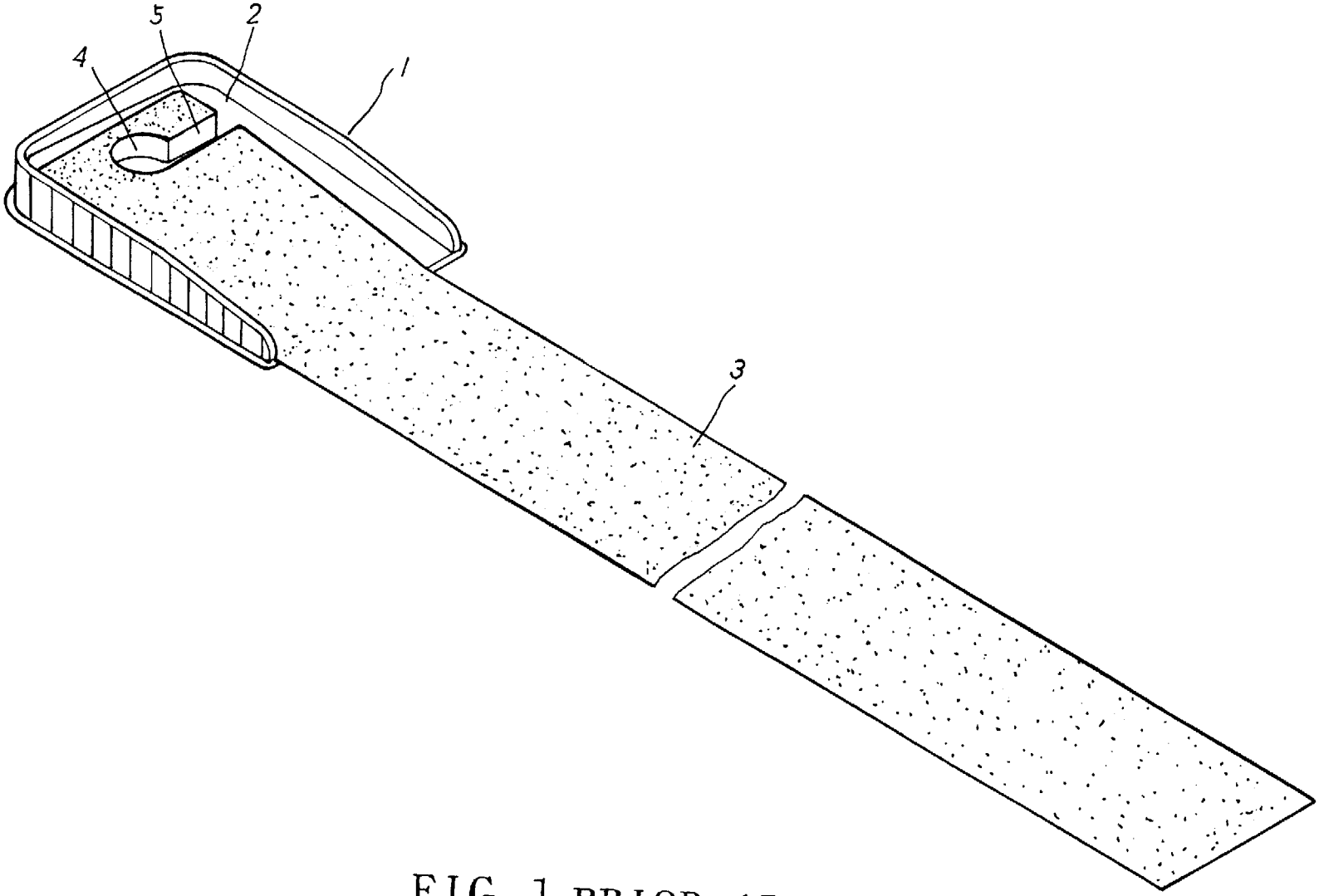
FIG. 1 PRIOR ART
FIG. 1 is a perspective view of a conventional golf targeting device.
Figure 2:
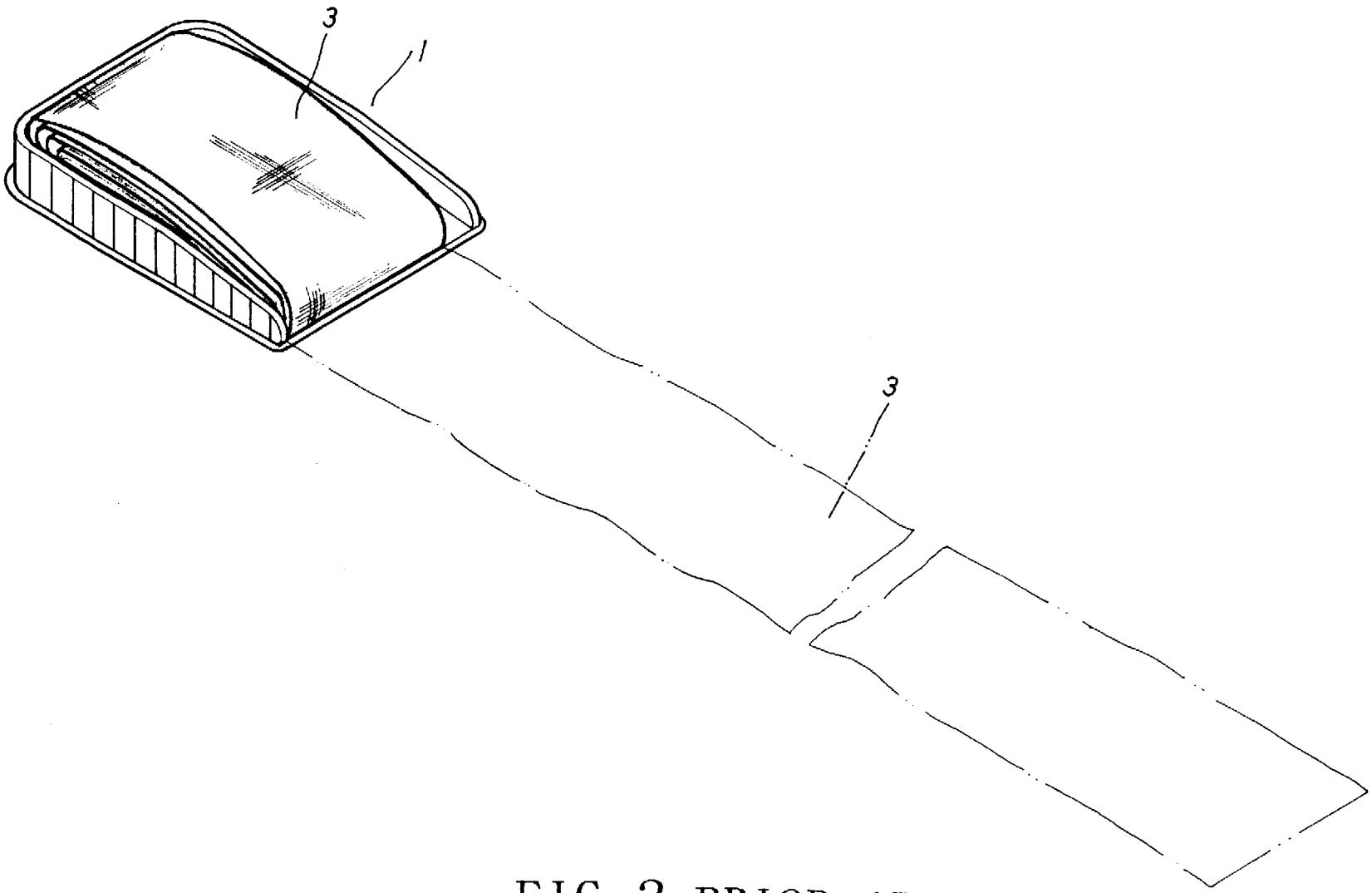
FIG. 2 PRIOR ART
FIG. 2 is a folded and unfolded view of the conventional golf targeting device.
Figure 3:
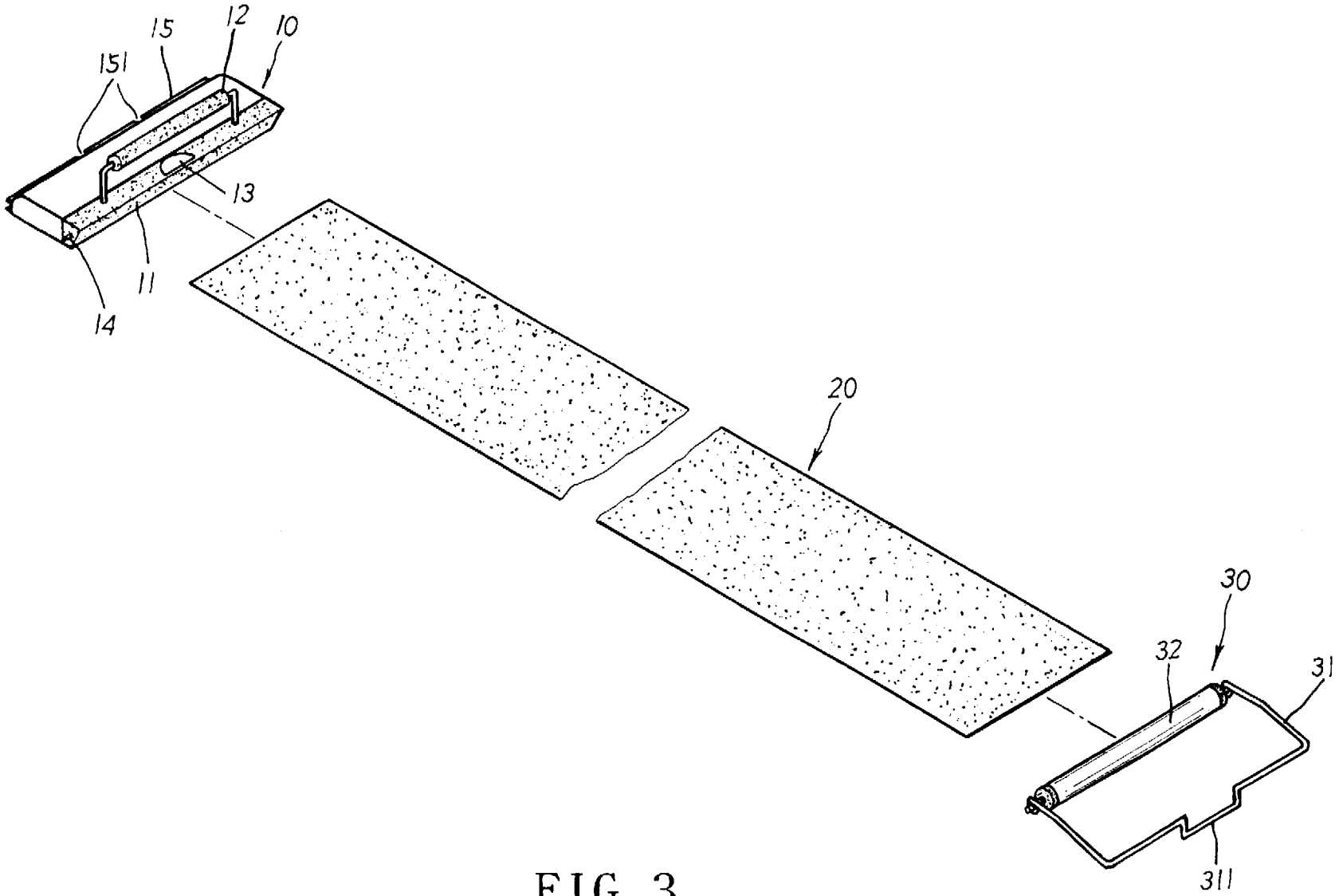
FIG. 3 is perspective exploded view of the present invention.

The present invention relates to a golf targeting device for golf practice comprising a targeting seat 18, an artificial lawn 20, and a movable winder 30. The targeting seat 10, in rectangular shape, is provided with a resilient rubber pad 11 at the front end and an engagement body 15 provided with a groove at the rear end. At the top face of the resilient rubber pad 11 is disposed a grip 12 extending upwardly from both lateral sides and a targeting sign 13 dispose at the middle section. A supporting post 14 is disposed at both lateral faces of the resilient rubber pad 11 respectively. And two recesses 151 are disposed at the top face of the engagement body 15.

The movable winder 30 is formed by a square U-shaped holder 31 pivotally joined to a cylinder 32; wherein the squared U-shaped holder 31 is provided with a handle 311 bent upwardly at the bottom middle section.

Figure 4:
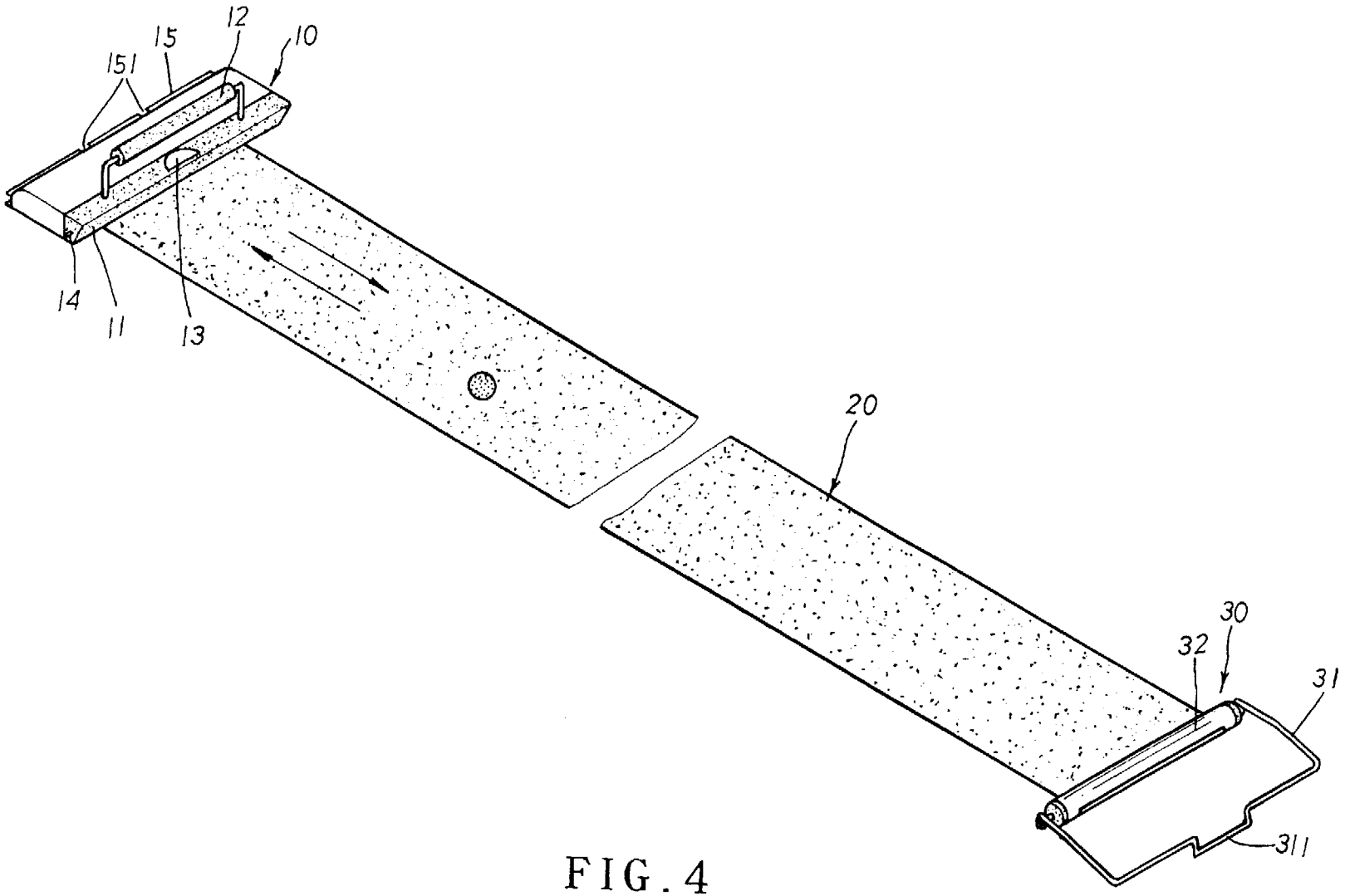
FIG. 4 is perspective assembled view of the present invention in practical use.

Please refer to FIG. 4. In assembly, one end of the artificial lawn 20 is fastened to the bottom front end of the targeting seat 10 and the other end thereof to the cylinder 32 of the movable winder 30. In practice, a golf ball is first positioned appropriately at the rear section near the movable winder 30, and then putted forwards, aiming at the targeting sign 13 disposed at the top face of the rubber pad 11 of the targeting device 10. And when touching the rubber pad 11, the golf ball will bounce back automatically due to the resilient force of the rubber pad 11 for another putting practice.

Figure 5:
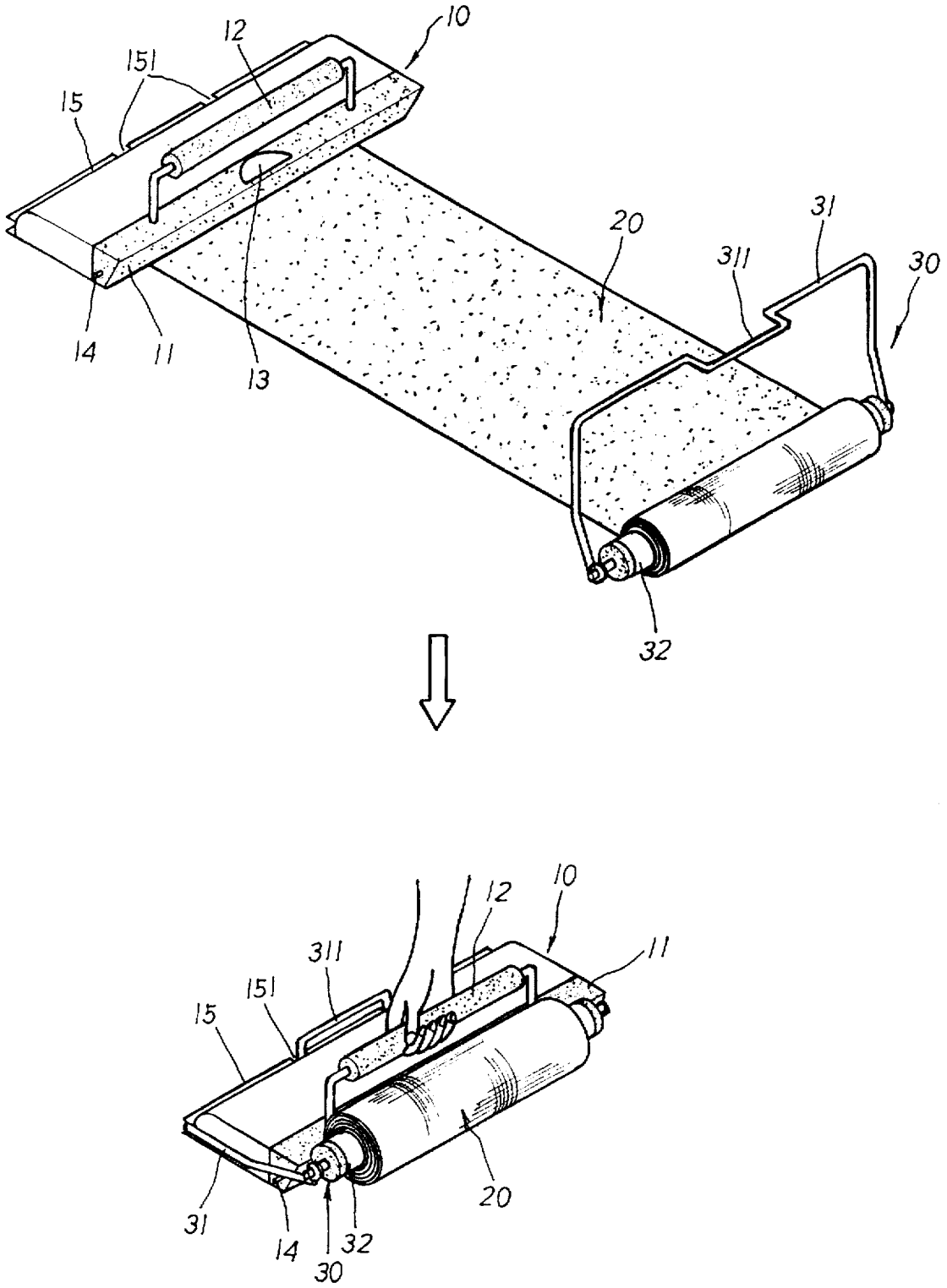
FIG. 5 is a perspective view of the present invention rolled up and carried.
Figure 6:
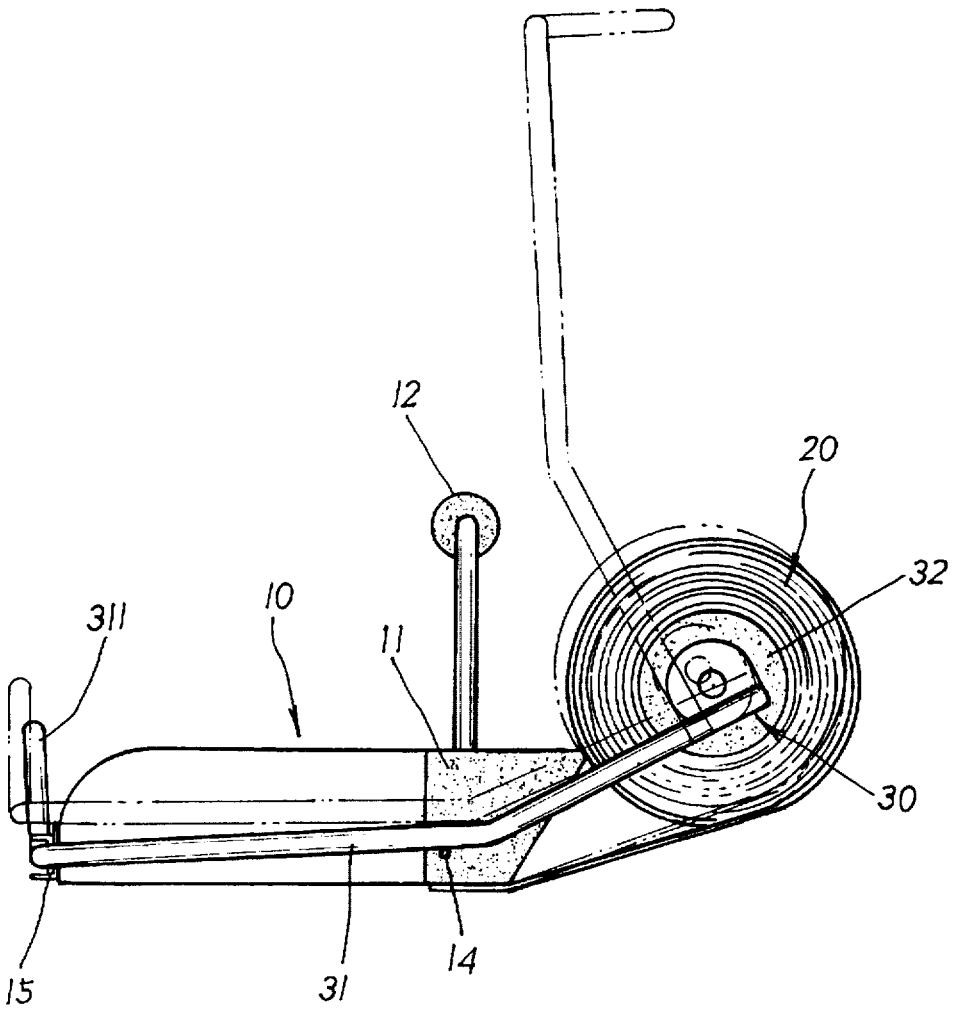
FIG. 6 is a perspective view of the holder of the present invention rolled up and engaged.

Please refer to FIG. 5. To store or carry the golf targeting device, the movable winder 30 held by the handle 311 of the holder 31 is rolled towards the targeting seat 10, winding up the artificial lawn onto the cylinder 32 of the winder 30 thereof. When approaching the targeting seat 10, the holder 31 of the movable winder 30 is then pushed downwards to engage within the groove of the engagement body 15 as shown in FIG. 6 with both lateral sides of the handle 311 of the holder 31 thereof engaged within the recesses 151 disposed at the top face of the engagement body 15 and both lateral sides of the holder 31 abut against supporting posts 14 disposed at both lateral faces of the rubber pad 11. The golf targeting device can then be lifted up for carrying by the grip 12 disposed at the top face of the rubber pad 11 of the targeting seat 10.

Thus, the golf targeting device of the present invention possesses many advantages. First, the golf targeting device can be easily rolled up, saving space in storage and convenient for transporting. Second, the unfolded golf targeting device can avoid corrugated folding lines generally found in a conventional golf targeting device so as to increase the longevity of the golf targeting device. Third, in practice, a golf ball will conveniently and automatically bounce back for repeated use.

What is claimed is:

1. A golf targeting device comprising:

a) a targeting seat of substantially rectangular configuration and having a front end and a rear end, the seat including a resilient rubber pad at the front end, an engagement body having a groove and a recess means at the rear end, a targeting sign on a top face of the seat, an upwardly extending grip, and a pair of supporting posts extending laterally from the seat;

b) a movable winder including a cylinder, a U-shaped holder pivotally secured to opposite ends of the cylinder, the holder being provided with a handle at a middle section thereof;

c) a length of artificial lawn means; a first end of the lawn means being secured to the targeting seat and a second end of the lawn means being secured to the movable winder; and d) wherein the lawn means may be rolled onto and unrolled from the winder by moving same towards and away from the targeting seat, and the holder being engageable within the groove and recess means at the rear end of the resilient rubber and in abutting engagement against the supporting posts when the lawn means is fully rolled on the movable winder for storing and transporting the device.

* * * * *